US007248162B2

(12) United States Patent
Nassimi

(10) Patent No.: US 7,248,162 B2
(45) Date of Patent: Jul. 24, 2007

(54) TEMPORARY MUTE OF ALARM IN WIRELESS ALERT SYSTEM

(76) Inventor: Shary Nassimi, 29670 Harvester, Malibu, CA (US) 90265

( * ) Notice: Subject to any disclaimer, the term of this patent is extended or adjusted under 35 U.S.C. 154(b) by 195 days.

(21) Appl. No.: 11/014,314

(22) Filed: Dec. 16, 2004

(65) Prior Publication Data

US 2006/0145845 A1 Jul. 6, 2006

(51) Int. Cl.
*G08B 13/19* (2006.01)

(52) U.S. Cl. ..... 340/541; 340/309.16; 340/527; 340/539.1; 340/565

(58) Field of Classification Search ..... 340/541, 340/528, 545.1, 545.2, 545.7, 551–557, 565, 340/567, 568.1, 500, 309.16, 527, 539.1
See application file for complete search history.

(56) References Cited

U.S. PATENT DOCUMENTS 4,122,437 A * 10/1978 Petersen ..... 340/528
4,745,400 A * 5/1988 Miura ..... 340/541
5,128,654 A * 7/1992 Griffin et al. ..... 340/567
5,570,079 A * 10/1996 Dockery ..... 340/541
6,741,176 B2 * 5/2004 Ferraro ..... 340/568.1

* cited by examiner

*Primary Examiner*—Davetta W. Goins
(74) *Attorney, Agent, or Firm*—George R. McGuire; David L. Nocilly; Bond, Schoeneck & King, PLLC

(57) ABSTRACT

A security system of the type wherein the occurrence of a monitored event, such as presence or motion of an individual at a first location, triggers an alarm at a second location. The invention provides a means of disabling the alarm during times when the device is subject to repeated actuation under conditions when the cause of the repeated actuation is know, as when workmen are present in the monitored location. An infrared sensor causes an RF transmitter to send a signal to a receiver. Switch means interposed between the receiver and alarm device have first and second states wherein the alarm-actuating signal from the receiver is passed and blocked, respectively, to the alarm. A push button is selectively operable to change the state of the switch means from the first to the second, whereby pressing the button effectively disables the alarm. A pulses counter or other such timing means is actuated by pressing the push button and establishes a time period at the conclusion of which the switch means is changed back to its first state, thereby again enabling the alarm device.

17 Claims, 1 Drawing Sheet

TEMPORARY MUTE OF ALARM IN WIRELESS ALERT SYSTEM

BACKGROUND OF THE INVENTION

The present invention relates to security systems having alarm means which are activated in response to signals generated by presence and/or motion detectors in an area to be monitored. More specifically, the invention relates to the addition to such systems of the capability of temporarily muting or disabling the alarm or other indicating device.

It is a common practice to install sensing devices in areas which are to be monitored for security purposes. The sensor (s) may be in the form of conventional presence or motion detectors which are actuated in response to a threshold level of infrared energy emitted by a person, vehicle, etc. in the vicinity of the sensor. The sensing device includes an RF transmitter which sends a signal to a receiver located at the desired monitoring location. The received signal activates an audible and/or visible alarm signal, discernable at the monitoring location.

While such systems serve well to perform the monitoring function intended, there are situations in which the alarm is not needed or wanted. For example, if there is a gardener or other workman in the vicinity of the sensing device, the alarm may be activated many times over a relatively brief time period even though the cause of alarm activation is known. Under such circumstances, it is sometimes the practice to disconnect the alarm unit from the power source by which it is activated, either by unplugging the unit or by operating and on/off button. Although this serves to prevent unwanted activation of the alarm, there is the possibility that power may not be restored to the system after the condition which prompted removal of power has ceased.

The object of the present invention is to provide a security system including one or more sensing devices and transmitters activated by presence or motion of an infrared-emitting body to send a signal to a receiver in order to activate an alarm wherein the alarm may be selectively deactivated and automatically reactivated after a fixed or adjustable time period.

Other objects will in part be obvious and will in part appear hereinafter.

SUMMARY OF THE INVENTION

The security system of the invention includes conventional sensing devices and RF transmitters located in areas which are to be monitored for presence of persons, vehicles, or the like, and one or more receiver units in the area where monitoring of the system is performed. The signal received by the RF receiver activates an audible and/or visible alarm, also of conventional design, which is powered by a battery or by an AC power source. In addition, the system of the present invention includes a switch selectively actuable to remove power from the alarm device, and a mechanical or electrical timer operable to reconnect the alarm device to the power supply. The timer may be of the type which establishes a fixed time period, being initiated by operator depression of a button to remove power to the alarm device and terminated at the end of the predetermined time period to reconnect the alarm to power. Alternatively, or in addition to the fixed timer, appropriate means may be provided for selecting a desired time period between removal and reconnection of the alarm device and the power supply.

The features of construction and operation of the invention will be more readily understood and fully appreciated from the following detailed disclosure, taken in conjunction with the accompanying drawings.

DETAILED DESCRIPTION

Figure 1:
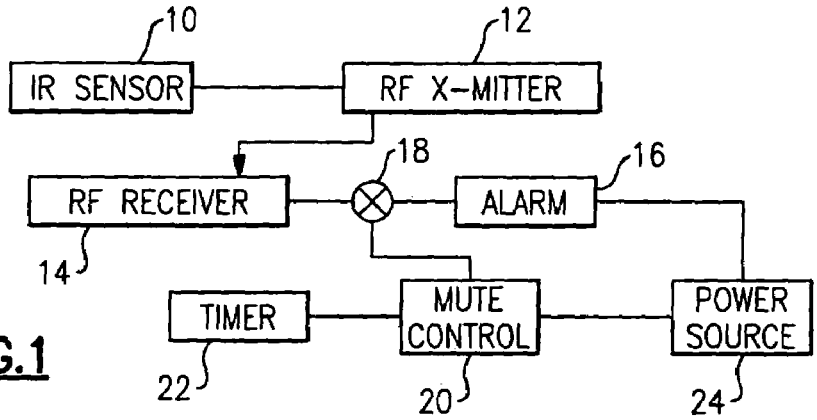
FIG. 1 is a partly diagrammatic, partly electrical schematic illustration of a first embodiment of the security system of the invention.

Referring now to the drawings, the security system of the invention as depicted in FIG. 1 includes IR senor 10, either a presence or motion detecting device, located in an area to be monitored for an event such as the presence of persons, vehicles, and/or other infrared emitting bodies. A common example of the type of security system in which the invention is employed is that of a driveway alert system. Although sensor 10 is indicated to be of the infrared detecting type, it will be understood that equivalent sensing means, such as electrical systems responsive to the presence of a large metal mass such as a vehicle, may be used, depending on the particular application of the system. At any rate, sensor 10 generates an electrical signal in response to a threshold level of the type of activity monitored by the system. The signal activates RF transmitter 12, which may conveniently be contained in a common housing with sensor 10, to transmit an RF signal which is received, normally at or near the location where the monitoring function is to be observed, by RF receiver 14.

A second electrical signal is generated in response to receipt of an RF signal of predetermined frequency by receiver 14 and activates alarm device 16, such as a speaker for audible indication of occurrence of the monitored condition or a lamp for visual indication, or both. Interposed between receiver 14 and alarm 16 is electronic switch 18, a device having two states. When switch 18 is in its first state, the signal from receiver 14 passes directly to alarm device 16 and activates the alarm; when the switch is in its second state it serves to block the signal from the receiver, whereby alarm device 16 is not activated by the sensed event by sensor 10. Of course, transmission of the signal from transmitter 12 to receiver 14 may be either via wire or wireless means. Switch 18 is changed from its first to its second state by manual actuation of mute control 20. Timer 22 is associated with mute control 20 and establishes a time period of fixed or variable duration, beginning with manual activation of mute control 20, before switch 18 reverts to its first state. Power source 24, either AC or DC, provides the necessary electrical power for operation of alarm 16 and mute control 20.

Figure 2:
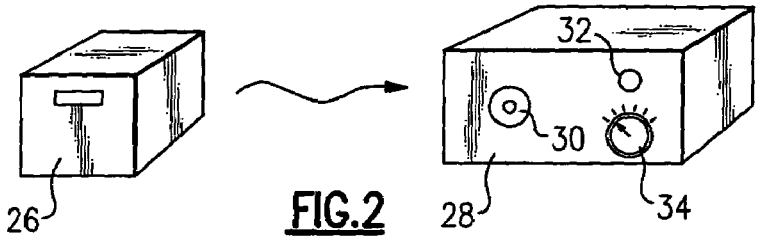
FIG. 2 is an illustration of a second embodiment of one of the elements of FIG. 1.

In FIG. 2 the elements shown diagrammatically in Figure are shown in a somewhat more representational form. Sensor 10 and transmitter 12 are contained within housing 26 which is mounted in the immediate vicinity of the area wherein the event is to be monitored. Housing 28 is located in a premises or other area where the alarm indicating occurrence of the monitored event is to be observed. Receiver 14 is contained within housing 28, together with the necessary wiring and components to complete the signal receiving and alarm device. Mounted upon a front wall of housing 28 are speaker and/or lamp 30, mute button 32 and manually operable timer device 34. When it is known that the event which activates the alarm will or may occur frequently over a certain time period, as when workmen are present in the monitored area, it may be desirable to deactivate the alarm for a time. This is easily and quickly accomplished by pressing mute button 32 once, thereby changing switch 18 from its first to its second state and disabling the alarm. The time period for which the alarm is disabled may be controlled by setting timer device 34 to a desired time, as with the indicated dial-type setting. Timer device 34 may be of the mechanical, electrical or electronic type from a simple spring-controlled switch to a pulse counting chip. In the preferred embodiment, timer device 34 is activated to begin the timing operation in response to initial pressing of mute control button 32 to disable the alarm. When the timing operation is completed, i.e., when timer 22 times down to zero, at the end of the period selected on device 34, switch 18 is again activated to return to its first state, once again enabling activation of speaker/lamp 30. It should also be noted that each time mute control button 32 is pressed, the state of switch 18 is changed; thus, if button 32 is pressed at any time during the time period established by timer 22, this serves to override the timer and enable alarm 16 prior to the expiration of the time period.

Figure 3:
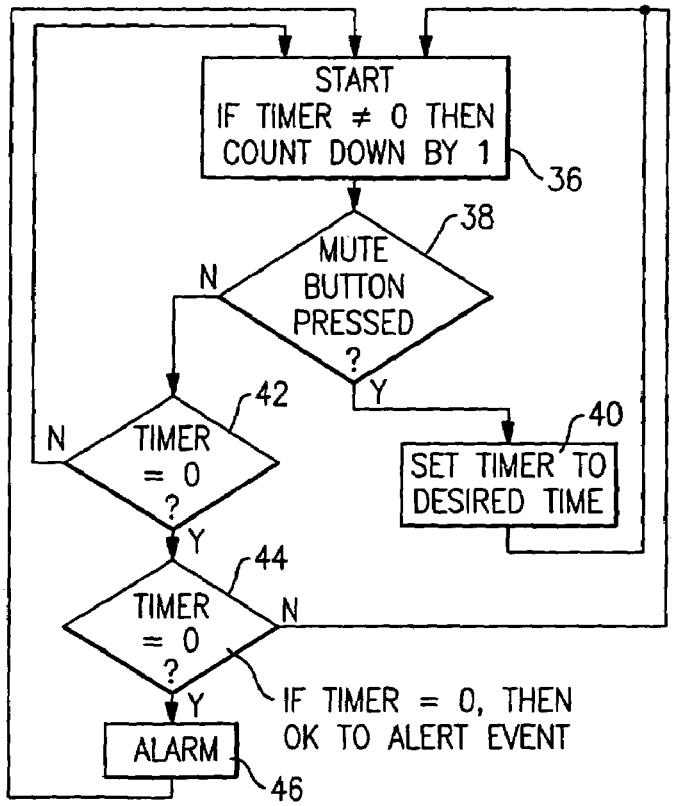
FIG. 3 is a flow chart illustrating the sequence of events in operation of the security system.

In FIG. 3 is shown a flow chart indication the sequence of events in operation of the security system of the invention. Block 36 indicates the start of the monitoring operation. Block 38 queries whether the mute button has been pressed and, if so, the operation is reverted to the start condition with the time period of alarm deactivation set as indicated by block 40. That is, the timing device begins counting down by 1 from the beginning of the time period until the timer has timed down to zero. If the mute button has not been pressed block 42 queries whether the monitored event has been detected; if not, the operation is reverted to the start condition without activating the alarm and if so, block 44 queries whether the timing device indicates zero time. If a time period remains on the timer, i.e., the time does not equal zero, the operation again reverts to the start condition. If the event is detected and time is zero, the alarm is activated, as indicated by block 46.

What is claimed is:

1. A security system for monitoring the occurrence of an event at or near a specified location, said system comprising;

a. a sensor actuable to generate a first electrical signal in response to said event;

b. an alarm device actuable to generate a visibly and/or audibly perceptible signal in response to electrical activation;

c. switch means interposed between said sensor and said alarm device, said switch means having a first state, wherein said first signal actuates said alarm device, and a second state, wherein said first signal does not actuate said alarm device;

d. control means manually operable to change the state of said switch means from said first to said second state;

e. timing means for establishing a time period following manual operation of said control means; and f. means for automatically changing the state of said switch means from said second to said first state at the conclusion of said time period.

2. The security system of claim 1 wherein said timing means is a pulse counter.

3. The security system of claim 1 wherein said time period is of fixed duration.

4. The security system of claim 1 and further including means for selectively varying the duration of said time period.

5. The security system of claim 1 and further including an RF transmitter actuable in response to said first signal to generate a second signal.

6. The security system of claim 5 and further including an RF receiver operable to receive said second signal from said transmitter and to actuate said alarm device in response to receiving said second signal when said switch means is in said first state.

7. The security system of claim 6 where said switch is a solid state device.

8. The security system of claim 7 wherein said sensor is a passive infrared presence detector.

9. The security system of claim 8 wherein said control means comprise a push-button.

10. A security system for monitoring the occurrence of an event in or near a first location and registering at a second location the occurrence of said event, said security system comprising:

a. a sensor operable to generate a first electrical signal in response to the occurrence of said event;

b. an RF transmitter actuable by said first electrical signal to transmit a second electrical signal;

c. an RF receiver operable to receive said second electrical signal and to generate a third electrical signal in response thereto;

d. an alarm device operable to generate a visually and/or audibly perceptible signal in response to reception at said alarm device of said third electrical signal;

e. switch means interposed between said receiver and said alarm device, said switch means having a first state, wherein said third electrical signal passes from said receiver to said alarm device, and a second state, wherein said third electrical signal is blocked from passing from said receiver to said alarm device;

f. manually operable control means for selectively changing said switch means from said first to said second state; and g. timing means operable upon changing said switch means from said first to said second state to establish a time period at the conclusion of which said switch means is changed from said second back to said first state.

11. The security system of claim 10 wherein said time period is of fixed duration.

12. The security system of claim 10 and further including means for selectively establishing the duration of said time period.

13. The security system of claim 10 wherein said sensor and said transmitter are positioned at said first location and said receiver, switch means, control means and alarm device are positioned at said second location.

14. The security system of claim 10 wherein said event is the presence of an infrared emitting body at or near said first location and said sensor comprises an infrared presence or motion detector.

15. The security system of claim 10 wherein said alarm device comprises a speaker operable to emit an audible sound in response to said third electrical signal.

16. The security system of claim 10 and further including manually operable means for changing said switch means from said second to said first state during said time period, thereby overriding said timing means and enabling said alarm device prior to expiration of said time period.

17. The security system of claim 16 wherein said control means comprise said manually operable means.

* * * * *